US007950666B2

(12) United States Patent
Stincelli et al.

(10) Patent No.: US 7,950,666 B2
(45) Date of Patent: May 31, 2011

(54) OMNIDIRECTIONAL TARGET SYSTEM

(75) Inventors: Nicholas Stincelli, Springville, UT (US); Kyle Bateman, Provo, UT (US); Tom Wright, Highland, UT (US); David Bassett, Springville, UT (US)

(73) Assignee: Action Target Inc., Provo, UT (US)

( * ) Notice: Subject to any disclaimer, the term of this patent is extended or adjusted under 35 U.S.C. 154(b) by 0 days.

(21) Appl. No.: 12/266,001

(22) Filed: Nov. 6, 2008

(65) Prior Publication Data

US 2009/0179382 A1 Jul. 16, 2009

Related U.S. Application Data

(60) Provisional application No. 60/986,254, filed on Nov. 7, 2007.

(51) Int. Cl.
*F41J 7/04* (2006.01)

(52) U.S. Cl. ..... 273/406; 273/386; 273/393

(58) Field of Classification Search ..... 273/403–410, 273/390–393, 374–378, 383–387, 366–371, 273/359

See application file for complete search history.

(56) References Cited

U.S. PATENT DOCUMENTS

| | | | | |
|---|---|---|---|---|
| 429,942 | A | 6/1890 | McBride | |
| 631,175 | A * | 8/1899 | Parnell | 273/406 |
| 840,610 | A | 1/1907 | Easdale | |
| 879,670 | A | 2/1908 | Petry | |
| 950,101 | A * | 2/1910 | Green | 273/368 |
| 960,085 | A | 5/1910 | Giles | |
| 1,207,456 | A | 12/1916 | Whelan | |
| 1,348,283 | A | 8/1920 | Koehl | |
| 1,424,632 | A * | 8/1922 | Fenton | 273/392 |
| 1,543,605 | A | 6/1925 | Gavard | |
| 1,559,171 | A | 10/1925 | Knowles | |
| 1,657,931 | A | 7/1926 | Krantz | |
| 1,640,954 | A * | 8/1927 | Mach | 273/369 |
| 1,738,874 | A | 12/1929 | Domingo | |
| 1,831,289 | A * | 11/1931 | Dally | 273/406 |
| 2,048,155 | A | 1/1935 | Armantrout | |
| 2,008,359 | A | 7/1935 | Lamb | |
| 2,039,552 | A | 5/1936 | Reynolds | |
| 2,085,933 | A | 7/1937 | Vaughan | |
| 2,104,171 | A | 1/1938 | Schwerin | |
| 2,179,471 | A | 11/1939 | Lee | |
| 2,284,510 | A | 5/1942 | Cates | |
| 2,372,111 | A | 3/1945 | Norberg | |

(Continued)

FOREIGN PATENT DOCUMENTS

| | | |
|---|---|---|
| CA | 2100631 | 2/1994 |
| EP | 528722 A1 | 2/1993 |
| GB | 2136932 | 9/1984 |
| GB | 2187270 | 9/1987 |

OTHER PUBLICATIONS

Caswell International Corp., Product Literature, Copyright 2002.

(Continued)

*Primary Examiner* — Mark S Graham
(74) *Attorney, Agent, or Firm* — Bateman IP Law Group

(57) ABSTRACT

An omnidirectional target system includes a target movable between a retracted position and an extended position and an actuation mechanism for moving the target to the extended position, the target and the actuation mechanism being releaseable so that the target can be moved back into the retracted position despite movement of the actuation mechanism.

21 Claims, 10 Drawing Sheets

U.S. PATENT DOCUMENTS 2,538,118 A 6/1949 Miller
2,587,042 A 2/1952 Haiselup
2,613,934 A 10/1952 Tabler
2,706,634 A 4/1955 Van Valkenburg
2,819,903 A 1/1958 Saunders
2,905,469 A * 9/1959 Taylor ..... 273/380
3,014,725 A 12/1961 Lewis
3,032,808 A 5/1962 Fleming
3,064,976 A * 11/1962 Kuhn ..... 273/369
3,087,701 A 4/1963 Wallace
3,103,362 A 9/1963 Elofson
3,113,773 A 12/1963 Ripepe
3,348,843 A 10/1967 Stanley
3,385,405 A 5/1968 Cullen
3,392,980 A 7/1968 Ortega
3,422,538 A 1/1969 Panissidi
3,515,388 A 6/1970 Zachmeier
3,540,729 A 11/1970 Rahberger
3,601,353 A 8/1971 Dale
3,802,098 A 4/1974 Sampson et al.
3,914,879 A 10/1975 Taylor, III et al.
3,992,007 A 11/1976 Seeman
4,076,247 A 2/1978 Kim et al.
4,084,299 A 4/1978 Noda
4,086,711 A 5/1978 Gammarino et al.
4,177,835 A 12/1979 Paley
4,205,847 A 6/1980 Steiger et al.
4,228,569 A 10/1980 Snyder
4,232,867 A 11/1980 Tate, Sr.
4,288,080 A 9/1981 Laporte et al.
4,294,452 A 10/1981 Schlotter et al.
4,340,370 A 7/1982 Marshall et al.
4,361,330 A 11/1982 Scharer
4,395,045 A 7/1983 Baer
4,440,399 A 4/1984 Smith
4,501,427 A 2/1985 Payne
4,506,416 A 3/1985 Ohminato et al.
4,540,182 A 9/1985 Clement
4,546,984 A 10/1985 Towle et al.
4,614,345 A 9/1986 Doughty
4,657,261 A 4/1987 Saunders
4,691,925 A 9/1987 Scholem
4,706,963 A 11/1987 Geuss
4,726,593 A 2/1988 Wade
4,739,996 A 4/1988 Vedder
4,743,032 A 5/1988 Summers et al.
4,807,888 A * 2/1989 Pidde et al. ..... 273/392
4,844,476 A 7/1989 Becker
4,898,391 A 2/1990 Kelly et al.
4,911,453 A 3/1990 Essex et al.
4,913,389 A 4/1990 McCracken
4,979,752 A * 12/1990 Fosseen ..... 273/392
5,054,723 A 10/1991 Arnold
5,145,133 A 9/1992 France
5,163,689 A 11/1992 Bateman
5,213,336 A 5/1993 Bateman
5,232,227 A 8/1993 Bateman
5,240,258 A 8/1993 Bateman
5,242,172 A 9/1993 Bateman
5,263,721 A 11/1993 Lowrance
5,277,432 A 1/1994 Bateman
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,400,692 A 3/1995 Bateman
5,433,451 A 7/1995 De Vries
5,535,662 A 7/1996 Bateman
5,598,996 A 2/1997 Rath
5,618,044 A 4/1997 Bateman
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,676,378 A 10/1997 West
5,765,832 A 6/1998 Huff
5,802,460 A 9/1998 Parvulescu et al.
5,811,718 A 9/1998 Bateman
5,822,936 A 10/1998 Bateman
5,829,753 A 11/1998 Wiser
5,865,439 A 2/1999 Marcuson
5,906,552 A 5/1999 Padilla
5,907,930 A 6/1999 Ricco
5,934,678 A 8/1999 Theissen et al.
5,947,477 A 9/1999 Turnipseed
5,950,283 A 9/1999 Sato
5,951,016 A 9/1999 Bateman
5,963,624 A 10/1999 Pope
5,967,523 A 10/1999 Brownlee
5,988,645 A 11/1999 Downing
6,018,847 A 2/2000 Lu
6,109,614 A 8/2000 Ciarcia
6,223,029 B1 4/2001 Stenman et al.
6,230,214 B1 5/2001 Liukkonen et al.
6,283,756 B1 9/2001 Danckwerth et al.
6,289,213 B1 9/2001 Flint et al.
6,308,062 B1 10/2001 Chien et al.
6,311,980 B1 11/2001 Sovine et al.
6,322,444 B1 11/2001 Matsui et al.
6,325,376 B1 * 12/2001 Elliott et al. ..... 273/406
6,328,651 B1 12/2001 Lebensfeld et al.
6,332,243 B1 12/2001 Kim
6,378,870 B1 4/2002 Sovine
6,398,215 B1 6/2002 Carroll
6,463,299 B1 10/2002 Macor
6,478,301 B1 11/2002 Witmeyer
6,484,990 B1 11/2002 Marshall
6,502,820 B2 1/2003 Slifko
6,533,280 B1 3/2003 Sovine et al.
6,543,778 B2 4/2003 Baker
6,575,753 B2 6/2003 Rosa et al.
6,588,759 B1 7/2003 Bateman
6,679,795 B2 1/2004 Ouimette et al.
6,718,596 B2 4/2004 Kohlstrand et al.
6,728,546 B1 4/2004 Peterson et al.
RE38,540 E 6/2004 Bateman
6,761,357 B2 7/2004 Witt et al.
6,776,418 B1 8/2004 Sovine et al.
6,808,177 B2 10/2004 Dehart
6,808,178 B1 10/2004 Sovine
6,896,267 B1 5/2005 Le Anna
6,975,859 B1 12/2005 Lambert et al.
6,994,347 B2 2/2006 Tessel et al.
6,994,348 B2 2/2006 Lambert et al.
6,994,349 B2 2/2006 Lambert et al.
7,134,977 B2 11/2006 Campbell et al.
7,140,615 B1 11/2006 Sovine et al.
7,175,181 B1 2/2007 Bateman et al.
7,194,944 B2 3/2007 Lambert et al.
7,201,376 B2 * 4/2007 Kuosa ..... 273/392
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,303,192 B2 12/2007 Marshall et al.
7,306,230 B2 12/2007 Lambert et al.
7,322,771 B1 1/2008 Marshall et al.
7,503,250 B2 3/2009 Lambert et al.
2005/0022658 A1 2/2005 Bateman et al.
2006/0290063 A1 * 12/2006 Hagar ..... 273/369
2006/0290064 A1 * 12/2006 Hagar ..... 273/392

OTHER PUBLICATIONS

Duelatron., Product Literature 1995.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Metal Spinning Target, Inc., Dueling Trees, Jul. 8, 2003.
Mike Gibson Manufacturing, Dueling Tree, Jul. 8, 2003.
Outwest MFG. Products, Product Literature, Jul. 8, 2003.
Porta Target, Product Literature, Circa 2000.
Shootrite, Tactical Training Target, published prior to Apr. 4, 2005.

* cited by examiner

OMNIDIRECTIONAL TARGET SYSTEM

PRIORITY

This application claims benefit and priority from U.S. Provisional Patent Application No. 60/986,254 filed Nov. 7, 2007, which is incorporated herein by reference in its entirety.

FIELD

The present invention relates to targets used for target practice. More specifically, the present invention relates to targets which can function in a variety of orientations and which can be "hit" during the resetting process.

BACKGROUND

In order to maintain proficiency in the use of firearms, it is common for law enforcement officers, members of the military and sportsmen to engage in target practice. While many perceive target practice as simply a method for improving accuracy, it is important for law enforcement officers and the like to conduct target practice in scenarios which improve timing and the ability to make split-second decisions on whether or not to fire. Such split-second decisions can literally mean the difference between life and death both for the officer, etc., and the potential threat.

In order to properly train police officers, it is important that they develop both hand-eye coordination and that they receive sensory stimulation which is associated with actual conditions. Thus, it is important for law enforcement officers and the like to be able to see when a target has been hit.

One common type of target is a pop-up target. A pop-up target is typically disposed behind a shield and includes a target which can be made to stand generally vertical. When the target is hit by a bullet, the target will fall over, thereby providing a visual stimulus that the target has been hit. An arm often engages the target and lifts it back into a vertical position to allow further shooting. Other targets may use a spring to draw the target back to the upright position.

One common problem with many pop-up targets is that the target may not fall when hit by a bullet. If the target is still being raised by the arm when it is struck by the bullet, the target will usually not fall and will continue to be raised by the arm. Thus, a person who is a fast shot may hit the target one or more times without the visual indication provided by the falling target. Additionally, the score for that participant may be inaccurate, as the scoring mechanism may require that the target fall to properly register a hit.

Another problem with pop-up targets is that movement of the targets typically is gravity dependent. Thus, a plate which is hit may slowly fall, causing the shooter to continue to fire until he or she sees that the target is falling. Likewise, being gravity dependent limits the orientations in which the target can be used. For example, a gravity dependent target cannot hang downwardly if it relies on gravity to retract the target from the shooter's view once hit.

Thus there is a need for an improved target. Such a target would include a head which could be hit at virtually any point in the resetting process and still indicate that the target has been hit. Likewise, it is preferred, though not required, that the target be able to be used in gravity independent orientations to allow for increased use scenarios.

SUMMARY

Embodiments of an improved target system and associated methods are disclosed below. According to some embodiments, a target may be provided which may be advanced from a retracted position to an extended or exposed position. At any point along the advancement of the target, the target may be hit by the shooter, thereby causing the target to return to its original retracted position.

The target may be moved from the retracted position to the exposed position by a moving catch which moves from a first, retracted position to a second, exposed position (the positions being determined functionally by the position of a target engaging the catch). At any time along the movement or after the target is fully exposed, the target may be hit by a bullet. Hitting the target with a bullet may cause the target to disengage from the catch and return to the retracted position.

In some embodiments, the target may also be returned to a retracted position if a shooter does not strike the target within a predetermined period of time. This can be accomplished, for example, by simply moving the catch back into the retracted position. The target may be biased into the retracted position and returns with the catch in some embodiments.

In some embodiments, the catch may continue to advance to the second, exposed position even after the target has been hit and returned to the retracted position. By monitoring the position of the target and the catch (or structures associated therewith) a target system can determine if the target is in a retracted position due to a shooter failing to hit the target within the predetermined exposure period, or due to the target having been hit by the shooter. Thus, the target system may be made to more accurately score the proficiency of the shooter.

These and other aspects of the embodiments of a target system are shown and described in the following figures and related description.

BRIEF DESCRIPTION OF THE DRAWINGS

Various embodiments and features of target systems are shown and described in reference to the following numbered drawings.

Figure 1:
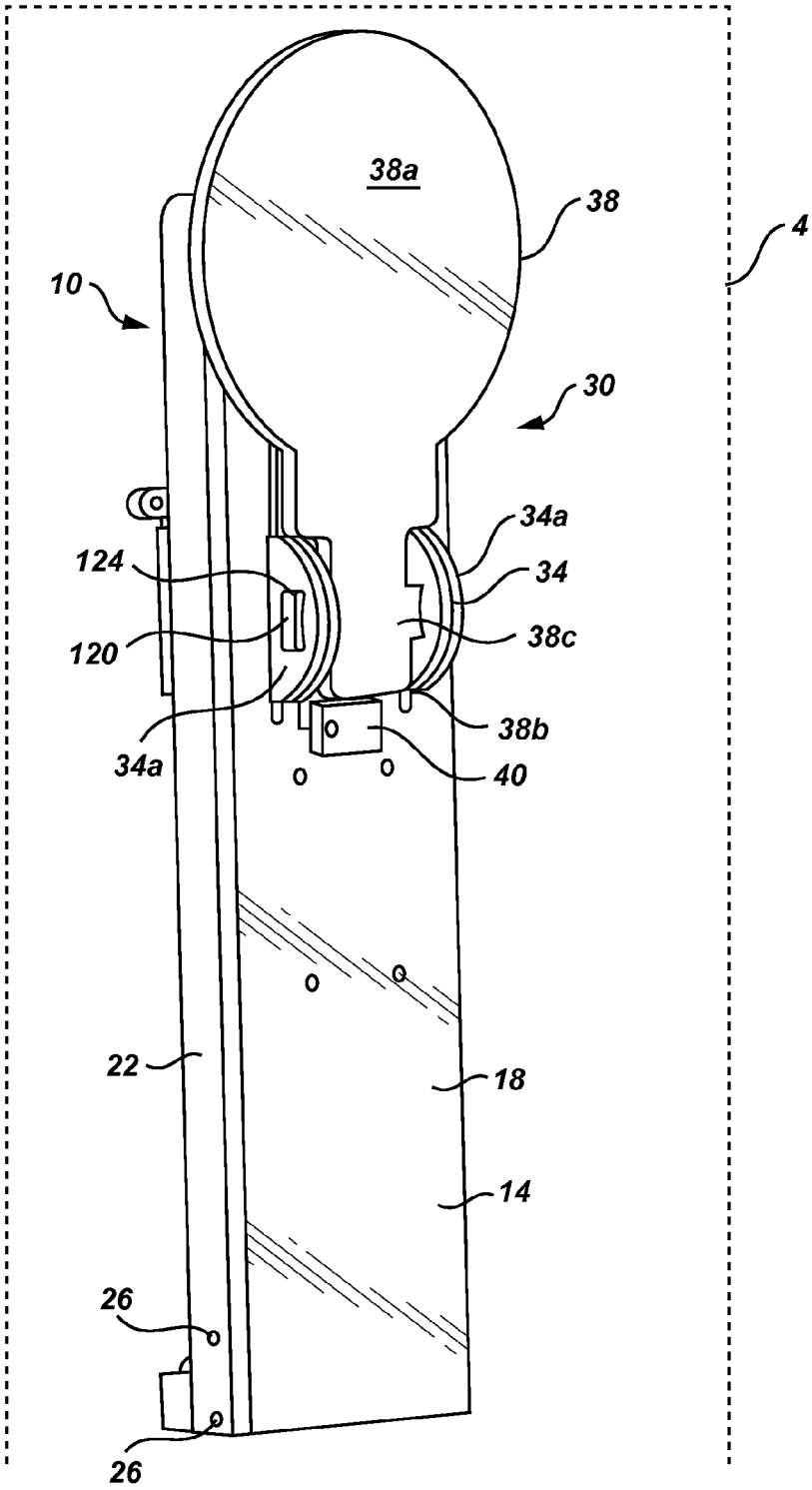
FIG. 1 shows a perspective view of an exemplary embodiment of a target system.

It will be appreciated that the drawings are illustrative and not limiting of the scope of the invention which is defined by the appended claims. The embodiments shown accomplish various aspects of the invention. It is appreciated that it is not possible to clearly show each element and aspect of an invention in a single figure, and as such, multiple figures are presented to separately illustrate the various details of embodiments of target systems in greater clarity. Several aspects from different figures may be used in accordance with target systems in a single structure. Similarly, not every embodiment need accomplish all advantages of various embodiments of target systems.

DETAILED DESCRIPTION

Embodiments of target systems and associated methods as shown in the accompanying drawings, which include reference numerals referred to below, provide details for understanding and practice by one skilled in the art. The drawings and descriptions are exemplary of various aspects of target systems and associated methods and are not intended to narrow the scope of the appended claims.

Turning now to FIG. 1, a perspective view of target system 10 is shown. Target system 10 may be typically disposed behind shield plate 4. Shield plate 4 may serve both to protect the non-exposed portions of target system 10 and to hide target 38 until it is presented to a shooter. Some portions of target system 10 may not be disposed behind shield plate 4, or other similar components. Thus, the terms exposed position and extended position are used interchangeably to mean when the target system has been activated to provide a target for a shooter, rather than requiring the use of a shield plate.

Target system 10 may include base 14, which may be used to support various components of target system 10. As shown in FIG. 1, base 14 is a piece of plate steel 18 with one or more supports 22 attached to base 14 to provide stability. Those skilled in the art will appreciate that base 14 could also be made from tubular steel, a large piece of angle iron or any of a number of other configurations. Supports 22 may be attached in a variety of manners, including screws 26, other fasteners, welding, unitary construction or machining, casting, etc.

Base 14 may be used to support target mechanism 30. Target mechanism 30 may include carriage 34, which is configured to move along base 14, and target 38 which may be pivotably or deflectably attached to carriage 34. Target 38 may further include head portion 38*a*, which may be presented to a shooter to be shot at, base portion 38*b*, and mounting portion 38*c*. Mounting portion 38*c* may be pivotably engaged with carriage 34.

An actuation mechanism may be included that includes catch 40. Catch 40 may be configured to engage target 38 (typically at bottom portion 38) and/or carriage 34 in such a manner that movement of catch 40 from a first, retracted position (shown in FIG. 1) to a second, extended position (discussed below) moves the target from a retracted position to an exposed position.

In some embodiments, if target 38 disengages from catch 40, carriage 34 and target 38 will return to the retracted position shown in FIG. 1, even if catch 40 continues to advance toward the extended position. Thus, the engagement of target 38 with catch 40 may form a release mechanism. For example, in some embodiments, if a shooter were to hit target 38 shortly after the top of head portion 38*a* moved above shield plate 4, target 38 would disengage from catch 40 and return to a retracted position even if catch 40 has not yet completed its cycle. This mechanism contrasts with many devices where the target cannot be dropped for a substantial part of the resetting process.

Figure 2:
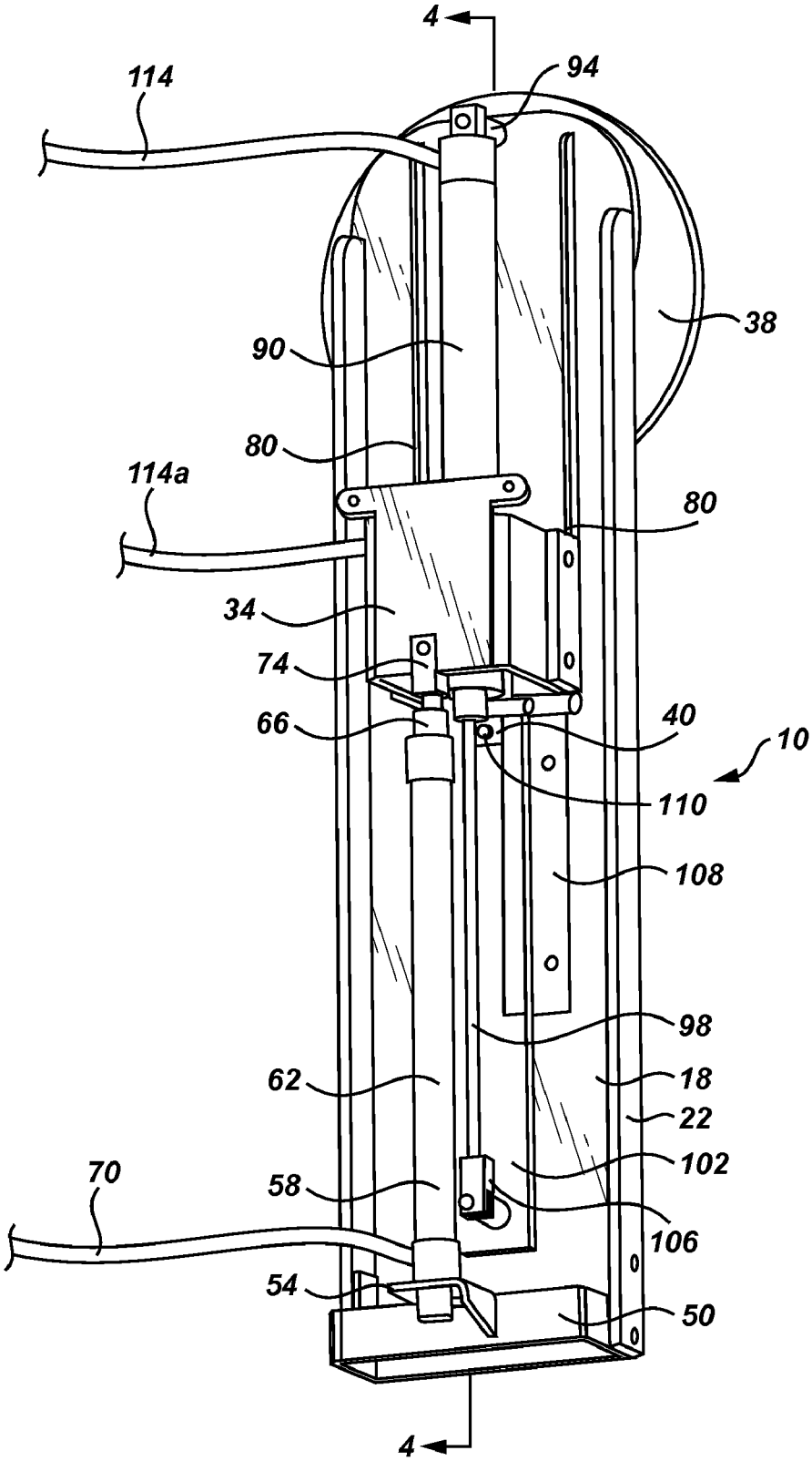
FIG. 2 shows a rear perspective view of the target system of FIG. 1.

Turning now to FIG. 2, a rear view of target system 10 as described with respect to FIG. 1 is shown. Target system 10 may include base frame 50 attached to base 18. Base frame 50 may include tab 54, which receives biasing member 58, which in turn may be operationally connected to target 38 (via carriage 34) to bias target 38 into a retracted position. Biasing member 58 may be a spring, an elastic band or some other structure configured to or sufficient to operate as described. In the illustrated embodiments, biasing member 58 is shown as pneumatic cylinder 62 with a piston (not shown in FIG. 2) and output shaft 66. Pneumatic line 70 may also be used to control the biasing properties of pneumatic cylinder 62, such as creating a downward force on the carriage and/or providing a generally linear application of force. Similarly, the response characteristics may be modified by adjusting biasing member 58, or through selection of particular biasing members to accomplish a desired effect or result. Pneumatic line 70 may be disposed to inject/withdraw air either above or below the piston.

In some embodiments, output shaft 66 may be attached to carriage 34. In such embodiments, the attachment between output shaft 66 and carriage 34 may be direct, or via coupling 74. Additionally, carriage 34 can be formed from a single piece of material or from several parts held together in any of a variety of acceptable ways.

Base 18, as shown in FIG. 2, may include a pair of channels 80 formed in base 18. In such embodiments, carriage 34 is slidably mounted in channels 80 to allow carriage 34 to move up and down between a retracted position, as shown in FIG. 2, and an extended position where target 38 is presented to a shooter. It will be appreciated that a single channel could be used or carriage 34 could be configured to engage the sides of base 18. Either way, carriage 34 may engage base 18 in a manner that causes carriage 34 to slide up and down relative to base 18.

In some embodiments, biasing member 58 may be used to bias carriage 34, and thus target 38, into the retracted position. As target 38 and/or carriage 34 is advanced by movement of catch 40 (FIG. 1) of the actuation mechanism, output shaft 66 may be drawn out of pneumatic cylinder 62, thus creating a pressure change. This can be accomplished by forming a vacuum, a positive pressure or both to bias output shaft 66 back toward pneumatic cylinder 62. If target 38 disengages catch 40, the vacuum (or positive pressure depending on which side of the piston) will cause output shaft 66 to retract, returning target 38 to the retracted position.

Additional portions of the actuation mechanism are also shown in FIG. 2, including the backside of catch 40 (FIG. 1). The actuation mechanism may include any of a variety of actuation mechanisms, including pneumatic actuation cylinder 90. Actuation cylinder 90 may be attached, via connector 94, to base 18, or in any other suitable manner. Actuation shaft 98 may be moved by actuation cylinder 90, thereby moving catch 40. As shown in FIG. 2, actuation shaft 98 may be attached to slide 102 by coupling 106. Catch 40 (FIG. 1) may be attached to slide 102 by bolt 110 or other attachment devices or manners. For example, shaft 98 could be attached directly to catch 40 if desired. A pair of brackets 108 may help keep movement of slide 102 substantially linear.

In some embodiments, pneumatic line 114 may be used to selectively inject air into or withdraw air from pneumatic actuation cylinder 90, thereby moving actuation shaft 98 and slide 102. Thus, pneumatic line 114 can be used to move catch 40 from the retracted position represented by FIG. 2 to an extended position, discussed below. This can be accomplished by drawing air out of the pneumatic actuation cylinder above the piston inside pneumatic actuation cylinder 90, injecting air in below the piston or both. Thus, additional pneumatic line 114*a* could also be present.

Figure 3:
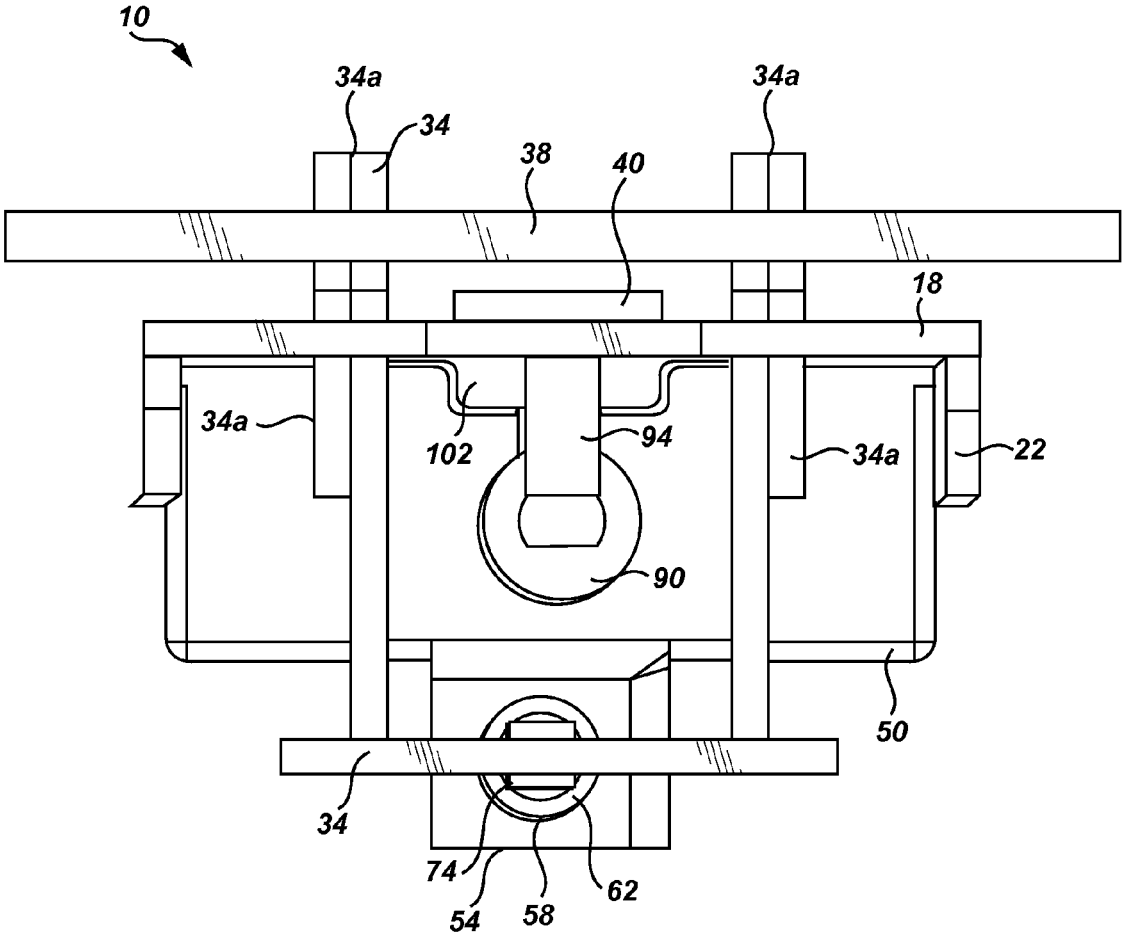
FIG. 3 shows a top view of the target system of FIGS. 1 and 2.

FIG. 3 illustrates a top view of target system 10 discussed above. For clarity, pneumatic lines 70 and 114 discussed regarding FIG. 2 have been omitted. The remaining structures which are visible have been provided with numbering corresponding to the numbering of relative portions illustrated in FIGS. 1-2. As shown in FIG. 3, target system 10 can be configured with a fairly shallow foot print. In such embodiments, the shallow footprint may allow target system 10 to be used in fairly tight configurations, such as an indoor shooting range, or behind a baffle suspended from the ceiling.

Figure 4:
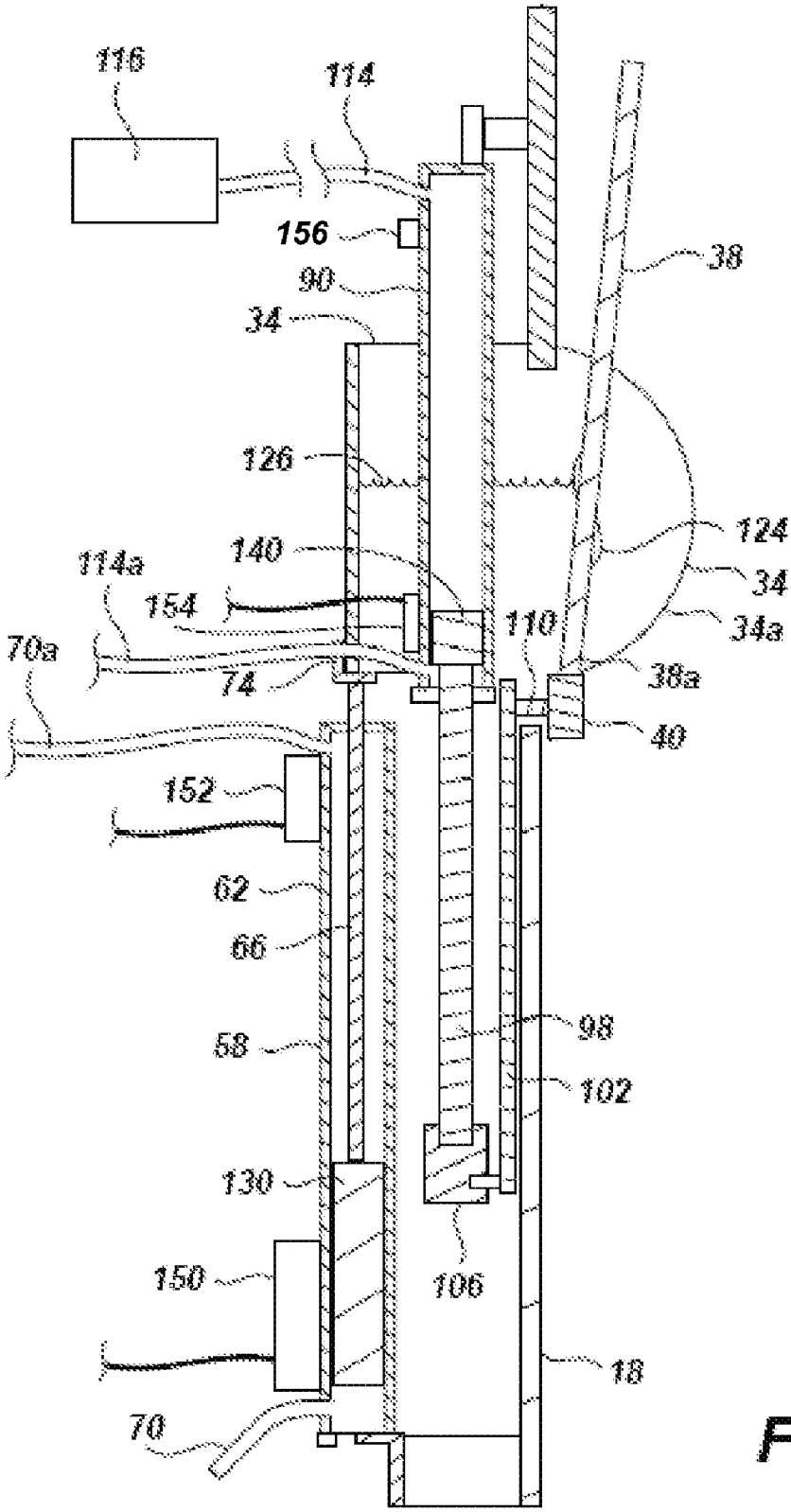
FIG. 4 shows a side cross-sectional view of the target system taken along line 4-4 of FIG. 2 with the target and an actuation mechanism in a retracted position.
Figure 5:
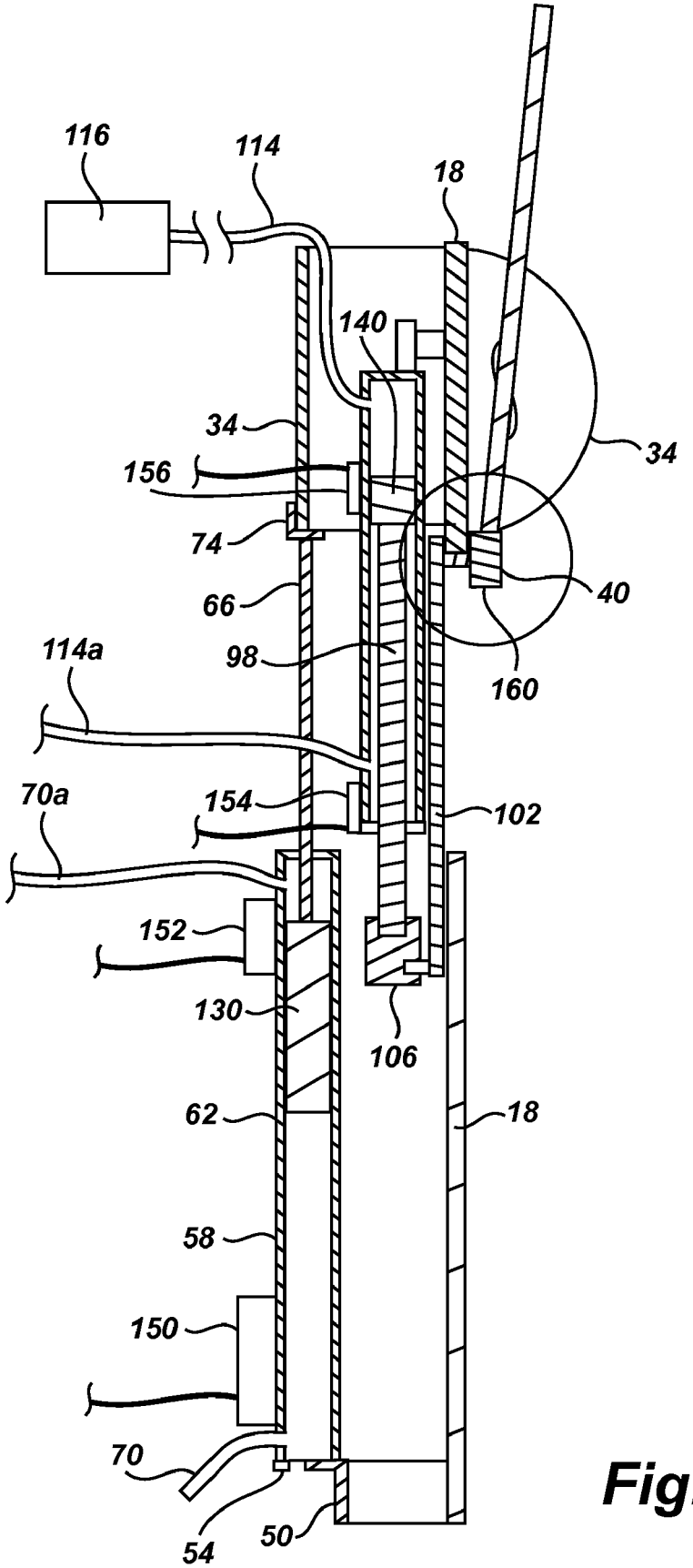
FIG. 5 shows a side cross-sectional view of the target system of FIG. 4 with the target and actuation mechanism in an extended or exposed position.
Figure 6:
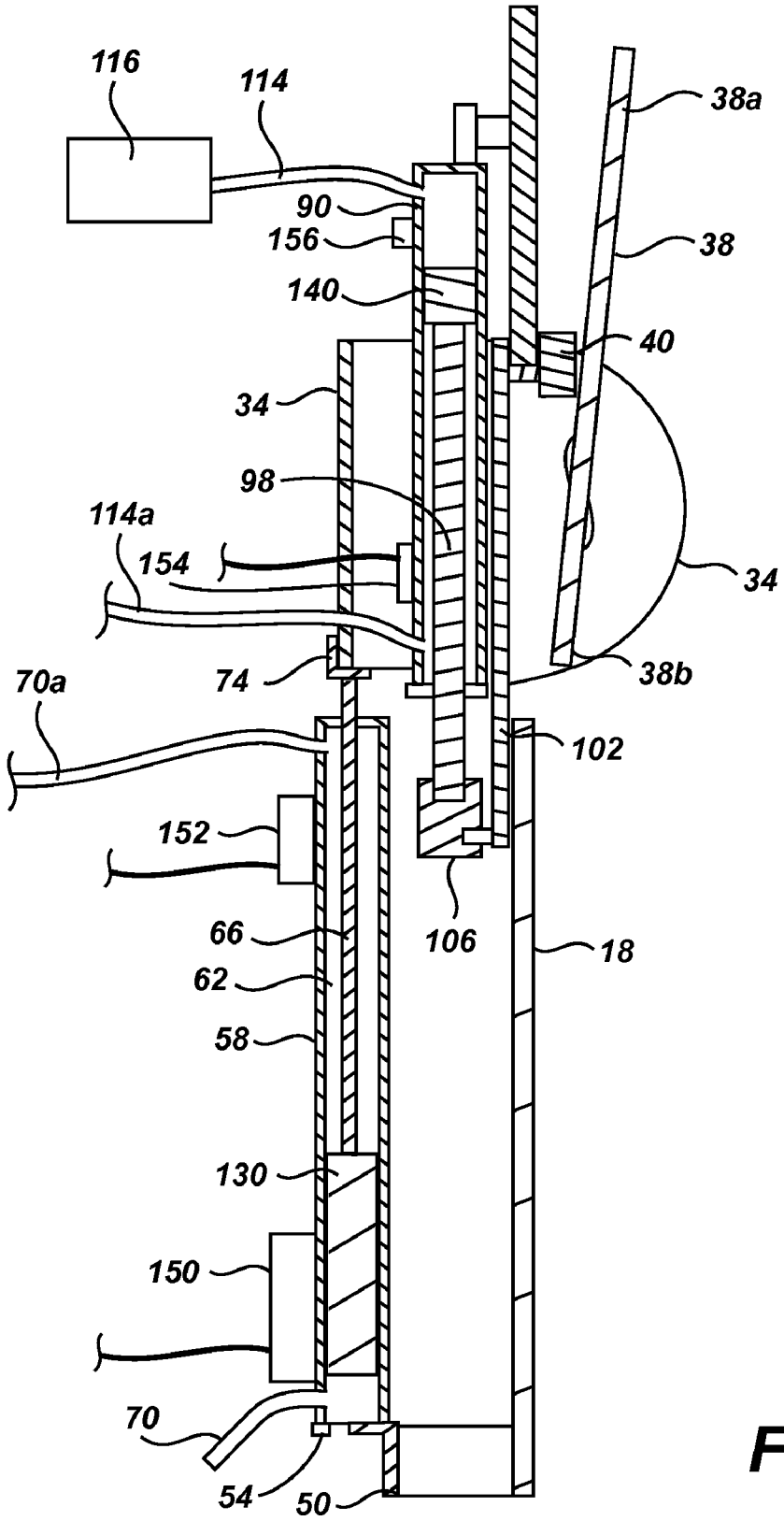
FIG. 6 shows a side cross-sectional view of the target system of FIG. 4 with the target in a retracted position while the actuation mechanism is in an extended position.

FIGS. 4, 5 and 6 illustrate side cross-sectional views taken along line 4-4 in FIG. 2, with FIG. 4 showing target 38 in a retracted, loaded position, with FIG. 5 showing target 38 in an extended position, and FIG. 6 showing target 38 in a retracted position caused by a shooter hitting the target.

In some embodiments, target 38 may be carried by the carriage 34. Target 38 may also include a pair of arms 120 (FIG. 1) which nest into a pair of generally hourglass shaped slots 124 in either arm 34*a*. Slots 124 and arms 120 may be other shapes as desired depending on the desired movement of the device. However, in some embodiments, the interaction between the two may allow arms 120 of target 38 to pivot a small amount within slots 124. For example, such a configuration may allow rotation of between about 5 to 15 degrees.

One advantage of the arm/slot engagement shown in FIGS. 1 and 4 may be that target 38 can be made from a single flat piece of steel, thereby avoiding the need for welding or other attachment devices, processes, or mechanisms. Welding is generally both expensive and a potential weakening process for an item which will be struck repeatedly by bullets, as the vibration of the target may eventually cause the weld to fail. However, a welded target may also be used.

Target 38 in FIG. 4 is shown in a retracted and loaded position. In other words, target 38 is down such that it would not be presented to a shooter. Target 38 may be tilted forward slightly so that bottom portion 38*a* of target 38 engages catch 40. In such a position, movement of catch 40 upwardly may cause target 38 and carriage 34 to move upwardly as well.

Target 38 and carriage 34 may be biased into the retracted position by pneumatic cylinder 62 and output shaft 66. A vacuum can be applied to piston 130 in pneumatic cylinder 62 by pneumatic line 70, or the cylinder and piston can simply be arranged such that movement of piston 130 from its resting position may creates a vacuum which biases output shaft 66 and attached carriage 34 into the retracted position. Likewise air can be injected (via line 70*a*) or simply remain present into pneumatic cylinder 62 so as to create pressure above piston 130 and bias piston 130 down into the position shown in FIG. 4.

As shown in FIG. 4, catch 40 may be moved into the retracted position. This may be accomplished by moving piston 140 in actuation cylinder 90 to extend actuation output shaft 98 by, for example, injecting air into actuation cylinder 90 from control module 116 via line 114. Movement of output shaft 98 may cause movement of coupling 106 downwardly, as shown in FIG. 4. This movement causes slide 102 to also move downwardly, bringing the catch into the retracted position.

Several sensors 150, 152, 154, and 156 may also be included, and are shown in FIG. 4. Sensors 150, 152, 154 and 156 may be attached to pneumatic cylinder 62 and actuation cylinder 90. Sensors 150, 152, 154 and 156 can be used to detect the position of pistons 130 and 140 in cylinders 62 and 90, respectively, or some other related structure. The relative positions of pistons 130 and 140 may provide an indication if 1) the catch and the target are in the retracted position; 2) the catch and the target are in the extended position; or 3) the catch is in the extended position and the target is in the retracted position. As will be explained in additional detail below, sensors 150, 152, 154, and 156 may also allow a shooting range or other advanced target system to determine if the target is in the retracted position because it has been withdrawn (i.e. the shooter failed to hit the target in the designated period) or has been hit by the shooter.

FIG. 4 also shows target biasing element 126, which may engage target 38. Target biasing element 126 may be a spring, elastic, or any other biasing member and may be used to control the movement of target 38 when hit by a bullet. For example, attaching target biasing element 126, such as an extension spring, above the pivot point of target 38 may make it easier for target 38 to be deflected by a bullet. Similarly, placing biasing element 126 below the pivot point may allow movement of bottom portion 38*b* of target 38 to return toward catch 40 more quickly after being hit. Using a compression spring for biasing element 126 may make target 38 more difficult to deflect if placed above the pivot point and easier to deflect if placed below. Thus, by controlling the type of spring and the attachment location, improved control may be provided over reaction of the target plate. For example, selecting appropriate components may allow use of target 38 with a low impact round—such as a .22 caliber and a high impact round such as a .45 caliber.

FIG. 5 illustrates target 38 and catch 40 disposed in an exposed or extended position, where target 38 is presented to the shooter. Pneumatic line 114 may be actuated by control module 116 (e.g. create a negative pressure with actuation cylinder 90 above piston 140), and/or pneumatic line 114*a* pressurized by a control module to create a positive pressure below the piston. In such embodiments, pressure may move piston 140 in actuation cylinder 90, causing actuation output shaft 98 to retract. The new position of piston 140 can be detected by sensor 156, which can be active or passive. In other words, sensor 156 may send a signal as soon as piston 140 is detected, or sensor 156 may only report whether or not piston 140 is detected when queried. Likewise, sensor 154 may report that piston 140 is no longer detected.

Movement of actuation output shaft 98 may also provide for movement of slide 102 via coupling 106. Movement of slide 102 may move catch 40, via connection 160, into the extended or exposed position. By monitoring the position of piston 140, sensors 156 or 154 can indicate that catch 40 has moved into a second, extended position.

Movement of catch 40 may also cause movement of target 38 and carriage 34. Movement of carriage 34 may move shaft 66 out of pneumatic cylinder 62 and change the position of piston 130 contained in cylinder 62. The position of piston 130 can be detected by the presence of adjacent sensor 152 or the absence of adjacent sensor 150. Thus sensor(s) 150 and/or 152 can indicate that target 38 is in an extended position where it is exposed for shooting.

Movement of piston 130 may create a biasing force within pneumatic cylinder 62. This may be a vacuum created below the piston or a pressure above the piston. (The force may be adjusted by providing pneumatic line 70 to modulate the pressure change.) Either way, pneumatic cylinder 62 may form a biasing force which attempts to return piston 130 (and ultimately target 38) to its original position.

Figure 5A:
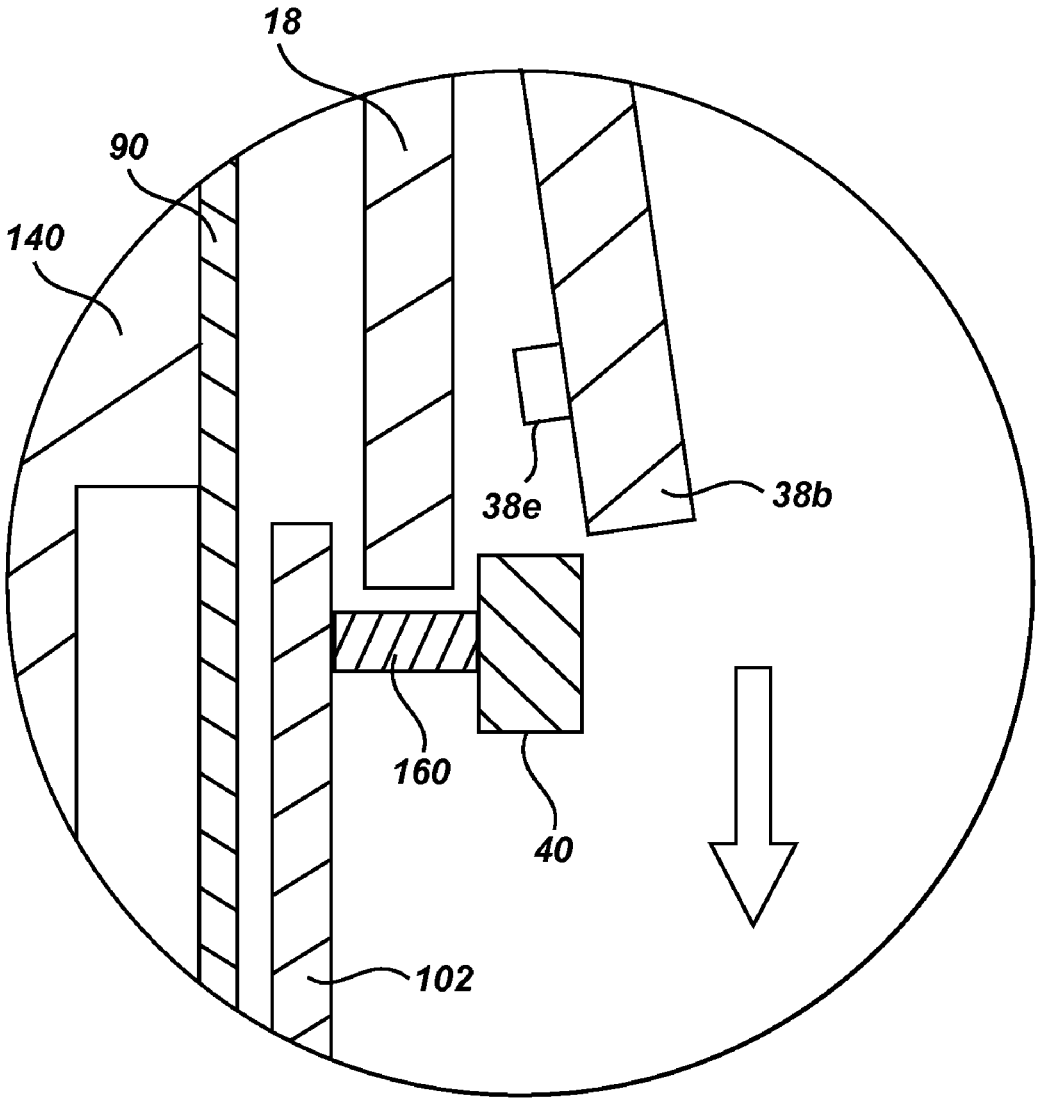
FIG. 5A shows a close-up of the engagement between the target and the actuation mechanism immediately after the target has been struck by a bullet.

Turning momentarily to FIG. 5A, a close-up of the engagement between target 38 and catch 40 is shown. The bottom of target 38 forms an engagement surface between catch 40 and target 38. In FIG. 5A, target 38 has been impacted by a bullet. In the illustrated embodiment, the impact causes bottom portion 38*b* of target 38 to pivot forwardly, breaking the engagement between the bottom of target 38 and catch 40. As soon as bottom portion 38*b* of target 38 is free, the biasing provided by pneumatic cylinder 62, etc., pulls target 38 and carriage 34 back into the retracted position as shown in FIG. 6.

It will be appreciated that catch 40 need not engage the bottom of target 38 as an engagement surface. For example, a ledge or ridge forming engagement surface 38*e* could be placed on target 38 to engage catch 40 and function as lower portion 38*b* described above. Such an engagement mechanism could also be used to require multiple hits of the target, if desired. For example, the bottom of target 38 may initially engage catch 40 and be dislocated by the first hit. Target 38 would then drop until ledge 38*e* engages catch 40, requiring a second hit for target 38 to fully retract. It will be appreciated that an engagement surface could be placed at numerous places along target 38.

FIG. 6 illustrates a side cross-sectional view of target system 10 with target 38 in the retracted position and catch 40 and remainder of the actuation mechanism in the extended position, thereby representing the target system a moment after the target has been struck by a bullet. Sensors 150, 152, 154 and 156 can determine, via the location of pistons 130 and 140, that the actuation mechanism is still in the extended position while target is in the retracted position. This indicates that target 38 has been hit by a bullet. If a shooter had failed to hit target 38 with a bullet, target 38 and catch 40 (and the remainder of the actuation mechanism) would have then returned to the retracted position together as shown in FIG. 4. Thus, an automated range system can determine that the shooter has hit the target and provide appropriate credit. With some prior art configurations, it is sometimes difficult to determine if the shooter actually hit the target.

One significant advantage of target system 10 may include that the shooter can be credited for an extremely quick shot. With some prior art configurations, it is not uncommon for an early shot to appear as a miss because the resetting arm is still moving the target back into place when the target is hit and will not allow it to drop properly. With target system 10 and other embodiments, hitting target 38 at any point between the retracted position shown in FIG. 4 and the extended position shown in FIG. 5 will cause the engagement surface (i.e. bottom portion 38*b* or ledge 38*e*) of target 38 to break free of catch 40 and return to the retracted position. This allows the shooter to fire whenever he or she is ready, rather than waiting for the target system to finish resetting the target. This is particularly important in a scenario in which the shooter must hit multiple targets.

The use of pneumatic cylinders for a target system may provide certain advantages over other devices. Many ranges are already equipped with pneumatic systems to actuate other types of targets. Additionally, pneumatic systems are also relatively resistant to weather concerns, such as rain and freeze/thaw cycles which create problems with electrical and hydraulic systems. However, it should be appreciated that embodiments of target system 10 may be implemented with various types of actuation mechanisms and is not limited to pneumatic systems.

Figure 7:
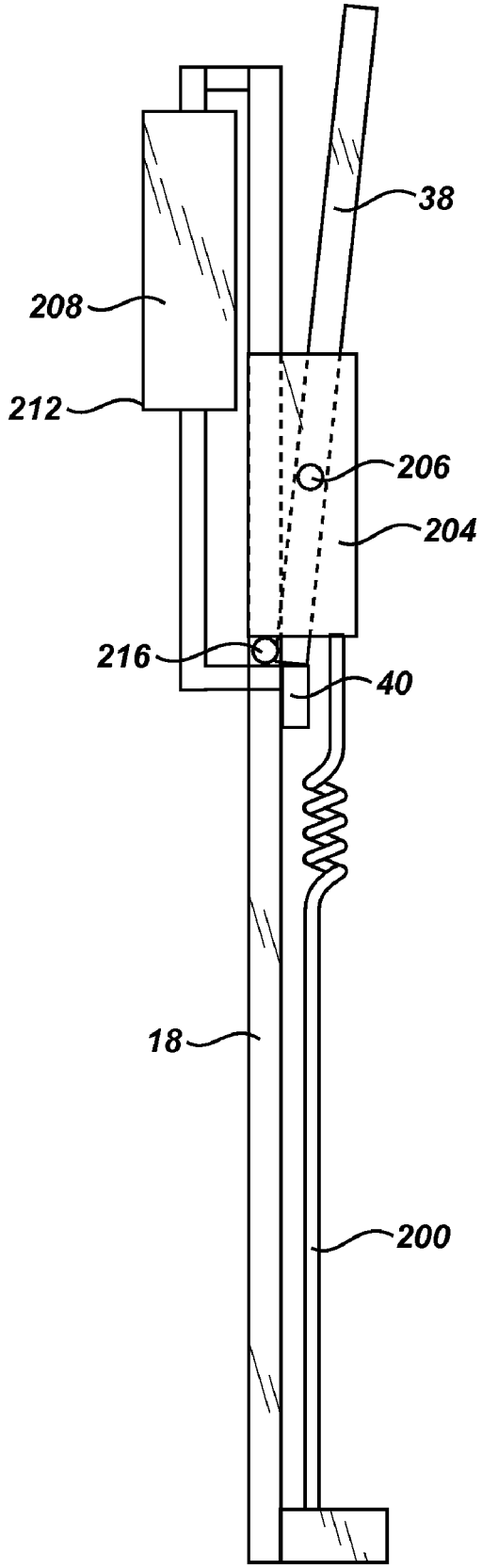
FIG. 7 shows a side view of an alternate configuration of a target system.

FIG. 7 shows a side view of another embodiment of a target system. In place of the pneumatic biasing element 58 of the embodiments described above, spring 200 is provided in the illustrated embodiment. Spring 200 may be disposed to pull carriage 204 back into a retracted position whenever it has not been forced into an extended position by actuation mechanism 208. In the illustrated embodiment, target 38 is not attached directly to the biasing element, but rather pivots about rod 206 which extends through carriage 204. It will be understood that any of the embodiments disclosed herein may be used with any of the biasing elements, or any biasing element sufficient to affect movement and reaction of the device as described.

Actuation mechanism 208 may use solenoid 212 or other electric driver to move catch 40 between the extended position and the retracted position. Movement of catch 40 into the extended position moves target 38 against the biasing of spring 200 until the target is hit and disengages from the catch.

As shown in FIG. 7, carriage 204 may slide along the outside of base 18 until it connects with stop 216. Thus, stop 216 may be used to stop the downward movement of base 18. The same function may be achieved in the embodiment discussed in FIGS. 1-6 by the engagement between carriage 34 and the bottom of channels 80.

The illustrated embodiments shown may be desirable because they allow the target system to be placed in any orientation. For example, the target system can be disposed upside down from the configuration shown in FIGS. 1-7 and 9, or disposed at a 90 degree angle from vertical. Either way, catch 40 will move target 38 into an exposed or extended position. As soon as target 38 is hit, it will return to a retracted position until it is again moved by catch 40. By determining the relative positions of the structures associated with the target and the actuation mechanism, a determination can be made whether there was a hit or whether the target was merely retracted after the time period for being exposed expired.

Figure 8:
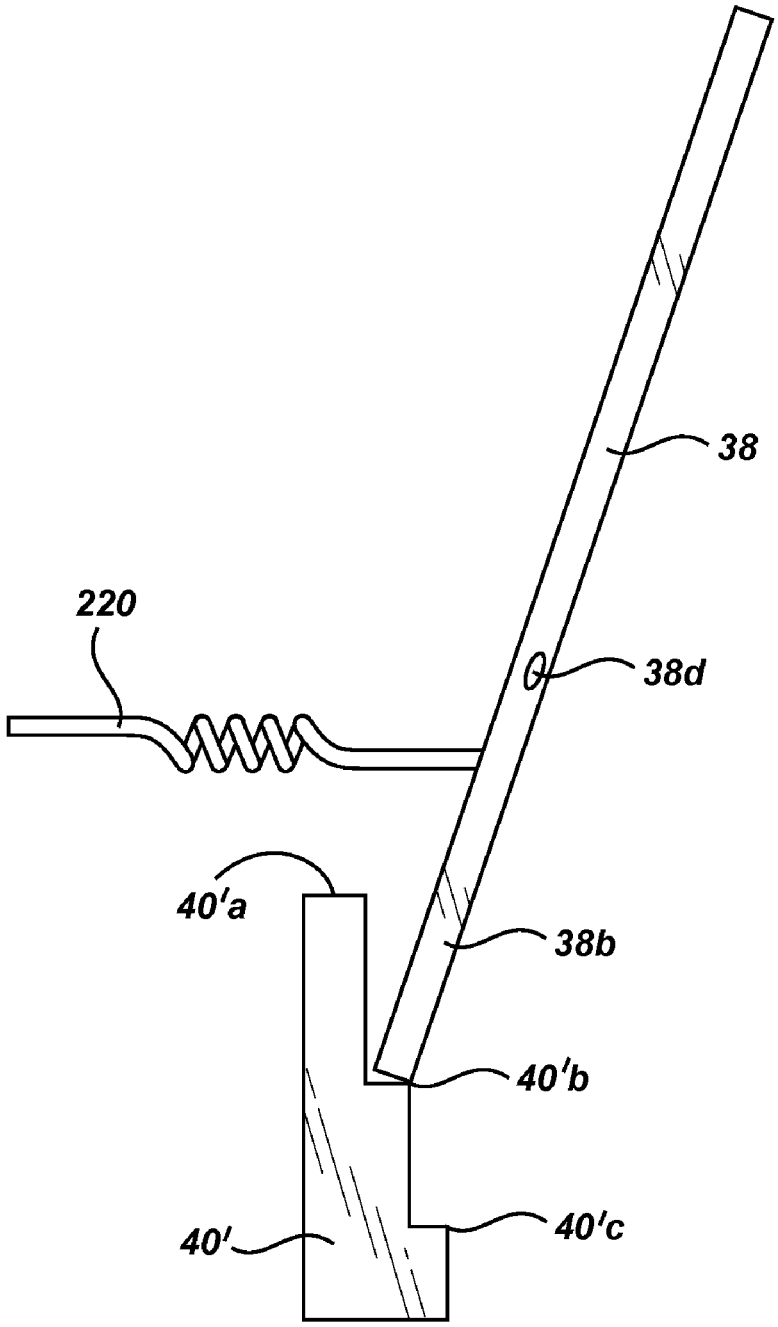
FIG. 8 shows a side view of an alternate configuration of a catch for a target system.

FIG. 8 shows a close-up side view similar to that of FIG. 5*a*. The parts have been numbered accordingly. Rather than providing a catch as shown in FIG. 5*a*, the catch is provided with steps 220. Steps 220 may allow the catch to reengage target 38 after is has been hit. Depending on the depth of steps 220 and the presence of a biasing element, such as a spring, etc., steps 220 can simply prevent target 38 from retracting when it has been hit relatively lightly, or can be used to require multiple hits to the target before the target will move to the retracted position.

One significant advantage of certain embodiments may be that the extension and/or retraction of target 38 are not gravity dependent. Target system 10 can be turned on its side or even used upside down. Thus, a shooting range could have the targets selectively extend down from behind a baffle hanging from the ceiling. Because it is not gravity dependent, target 38 will retract upwardly if hit by a bullet and will remain retracted until the catch is retracted and then actuated to move the target back into the extended position.

FIG. 8 shows other embodiments of catch 40' as it engages target 38. It will be appreciated that catch 40' can be used in either of the prior configurations discussed. As such the remaining structures of the other illustrated embodiments are not shown in FIG. 8 for the purpose of brevity, but will be understood as such structures may be present to make catch 40' function as described.

In the embodiment illustrated in FIG. 8, catch 40' has a plurality of steps 40'*a*, 40'*b* and 40'*c*. Each step 40'*a*-40'*c* forms a surface for engagement by bottom portion 38*b* of target 38 (or by some other engagement surface such as ledge 38*e* in FIG. 5A). When catch 40' moves into the retracted position, the catch passes bottom portion 38*b* of target 38 sufficiently that the target engages at least one of the surfaces formed by the steps. Thus, for example, catch 40' will retract until bottom portion 38*b* rests on first step 40'*a*. Catch 40' may then move into the extended position as discussed above.

Once the shooter hits target 38, the engagement surface on bottom portion 38*b* may be moved outwardly away from catch 40' as discussed above relative to FIG. 5A; target 38 would then be pulled down into the retracted position. With catch 40', however, the engagement surface bottom portion 38*b* of target 38 will move outwardly sufficient to be released from step 40'*a*, but will engage second step 40'*b*. Engagement of second step 40'*b* may be encouraged by a biasing member, such as extension spring 220 which attaches to target 38 below a point of rotation 38*d*, or a compression spring above the point of rotation.

When target 38 is hit a second time, the engagement surface, such as bottom portion 38*b* may be released from second step 40'*b* and fall to third step 40'*c*. Thus, in such a configuration, three hits on target 38 may cause target 38 to fall into the retracted position as shown in FIG. 4. Removing or reducing the biasing of the biasing element may make the behavior of the target 38 less predictable. Thus, depending on how quickly bottom portion 38*b* (or other engagement surface) bounces back toward its initial position, target 38 may move to second step 40'*b*, third step 40'*c*, or to a retracted position after the first shot.

With each of the embodiments discussed herein, target 38 may be hit at any point along its advancement as it moves from the retracted position to the extended position. For example, with the catch 40' in FIG. 8, an extremely fast shot could hit the target three times before the catch reaches its extended position. Of course, such depends on the speed at which the catch moves and the type of weapon being fired.

The use of the catch 40' allows a police officer to work on reaction in a case in which the first shot does not incapacitate a threat. Two or even three shots may be necessary. As with the other configurations, the catch 40' can be used regardless of the orientation of the target system.

Figure 9:
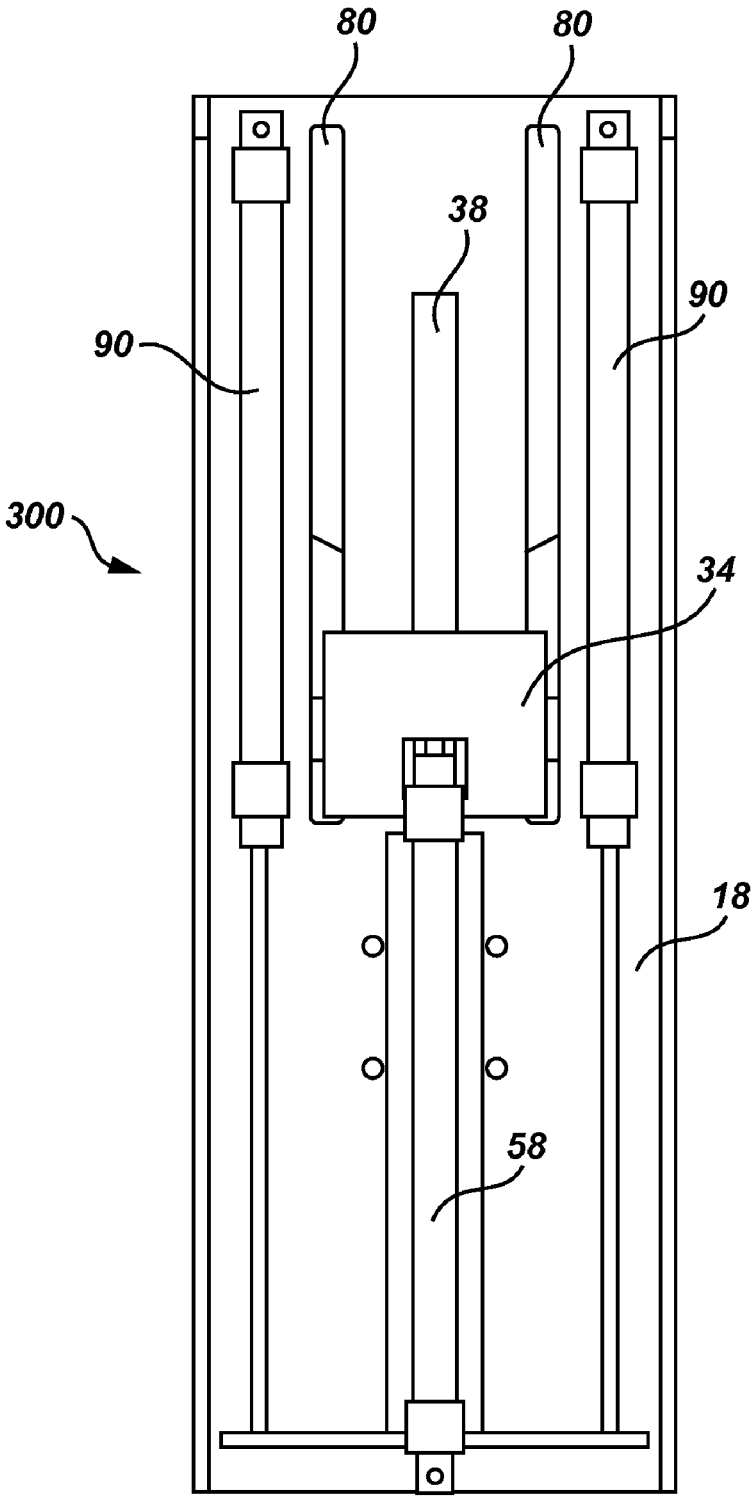
FIG. 9 shows a rear view of an alternate embodiment of a target system.

FIG. 9 illustrates another embodiment of target system 300. Target system 300 may be similar to target system 10 illustrated above, but with multiple pneumatic actuation cylinders 90. One advantage with multiple pneumatic actuation cylinders 90 is that the load of moving carriage 34 and the target may be shared between two or more actuation cylinders 90, resulting in the possibility of using smaller cylinders and arranging the components of target system 300 into a thinner side profile. In such a configuration, biasing member 58 may be closer to base 18. In the illustrated configuration, the movement of target 38 may be smoother with less wear and tear on the target system 300.

In some embodiments, biasing member 58 may also include multiple biasing elements such as pneumatic cylinders, springs, etc. Similarly, although two pneumatic actuation cylinders 90 are shown in the illustrated embodiment in FIG. 9, additional actuators may be used with target system 10 or 300, or other similar target systems.

One advantage of certain applications of the present invention is the ability to dispose the target system independent of gravity. In other words, the target may move upwardly, downwardly or sideways while moving from the retracted position to the extended position. Further, the biasing elements, such as cylinder 62, spring 200 or other analogous structure may be modified or adjusted to compensate for increased forces on the target based on the relative orientation to the ground. For example, the air pressure in cylinder 62 may be adjusted to compensate for the additional force needed to return the target to the retracted position when the target is being drawn upwardly into the retracted position, as opposed to downwardly as illustrated.

It will be appreciated that numerous changes may be made to the above-disclosed embodiments of target systems and associated methods without departing from the scope of the claims. The appended claims are intended to cover such modifications.

What is claimed is:

1. A target system, comprising:

a target configured to be movable between a retracted position and an extended position, wherein the target is presented to a shooter in the extended position;

a catch configured to engage the target and move the target into the extended position; and a biasing member operationally connected to the target and configured to move the target back into the retracted position; and wherein the biasing member includes a pneumatic cylinder and a shaft extending out of the pneumatic cylinder, wherein the biasing member is configured such that movement of the shaft out of the cylinder creates a pressure in the cylinder.

2. A target system, comprising:

a target configured to be movable between a retracted position and an extended position, wherein the target is presented to a shooter in the extended position;

a catch configured to engage the target and move the target into the extended position; and a biasing member operationally connected to the target and configured to move the target back into the retracted position; and further comprising a pneumatic actuation mechanism, the catch forming part of the actuation mechanism, and wherein the pneumatic actuation mechanism is configured to move the catch between the retracted position and the extended position.

3. A target system, comprising:

a target configured to be movable between a retracted position and an extended position, wherein the target is presented to a shooter in the extended position;

a catch configured to engage the target and move the target into the extended position; and a biasing member operationally connected to the target and configured to move the target back into the retracted position; and further comprising a plurality of sensors, wherein at least one of the plurality of sensors is configured to determine the location of the target, and wherein another of the plurality of sensors is configured to determine the location of the catch.

4. A target system, comprising:

a target configured to be movable between a retracted position and an extended position, wherein the target is presented to a shooter in the extended position;

a catch configured to engage the target and move the target into the extended position; and a biasing member operationally connected to the target and configured to move the target back into the retracted position; and wherein the catch includes a plurality of steps.

5. A target system, comprising;

a target movable between a retracted position and an extended position;

a pneumatic actuation mechanism configured to selectively engage the target to move the target from the retracted position to the extended position;

a release mechanism configured to disassociate the target from the actuation mechanism at any point between the retracted position and the extended position; and a biasing member attached to the target for biasing the target toward the actuation mechanism, wherein the target pivots to release from the actuation mechanism and wherein the biasing member attached to the target for biasing the target toward the actuation mechanism biases the target against pivoting away from the actuation mechanism.

6. The target system of claim 5, further comprising a biasing device operationally connected to the target, the biasing device being configured to bias the target into the retracted position regardless of whether the extended position is above or below the retracted position.

7. The target system of claim 5, wherein the target has an engagement surface, wherein the actuation mechanism includes a catch, and wherein the release mechanism is configured to selectively provide an engagement between the catch and the engagement surface of the target.

8. The target system of claim 6, wherein the biasing device includes a spring.

9. The target system of claim 5, wherein the target has an engagement surface, wherein the actuation mechanism includes a catch, and wherein the release mechanism is configured to disengage the catch upon impact of a projectile against the target.

10. The target system of claim 5, further comprising a generally stationary base and a carriage slidable relative to the base, the carriage being attached to the target for carrying the target and the actuation mechanism, including a catch, the actuation mechanism moving the catch along the base to move the target from the retracted position to the extended position.

11. The target system of claim 5, wherein the biasing member has a pull which is greater than the weight of the target such that the biasing member maintains the target in the retracted position even if the retracted position is disposed directly above the extended position.

12. A target system, comprising;

a target movable between a retracted position and an extended position;

an actuation mechanism configured to selectively engage the target to move the target from the retracted position to the extended position;

a release mechanism configured to disassociate the target from the actuation mechanism at any point between the retracted position and the extended position; and a biasing device operationally connected to the target, the biasing device being configured to bias the target into the retracted position, the biasing device including a pneumatic cylinder.

13. A target system, comprising;

a target movable between a retracted position and an extended position;

an actuation mechanism configured to selectively engage the target to move the target from the retracted position to the extended position, wherein the actuation mechanism includes a catch; and a release mechanism configured to disassociate the target from the actuation mechanism at any point between the retracted position and the extended position;

wherein the catch includes a plurality of steps.

14. The target system of claim 13, wherein the actuation mechanism includes, a pneumatic cylinder, and a shaft extending from the pneumatic cylinder, the shaft being operationally connected to the catch.

15. A target system comprising;

a target movable between a retracted position and an extended position, the movement of the target between the rectracted position and extended position being generally linear;

an actuation mechanism configured to selectively engage the target to move the target generally linearly from the retracted position to the extended position, the actuation mechanism being configured to move the target between the retracted position and the extended position independent of the orientation of the target;

a release mechanism configured to disassociate the target from the actuation mechanism at any point between the retracted position and the extended position; and a biasing member configured to pull the target into the retracted position when the target is disassociated from the actuation mechanism, wherein the biasing member comprises a pneumatic piston.

16. The target system of claim 15, wherein the actuation mechanism comprises a pneumatic piston for selectively moving the target into the extended position.

17. The target system of claim 15, further comprising a carriage for carrying the target and a base having a plurality of slots formed therein and wherein the carriage extends through the slots in the base and holds the target adjacent the base.

18. A target system comprising:

a target extendable from a retracted position to an extended position;

a carriage for holding the target;

an actuation mechanism configured for contacting the target and advancing the target from the retracted position to the extended position;

a biasing mechanism attached to at least one of the target and the carriage configured to bias the target back into the retracted position;

wherein the target is movably attached to the carriage, such that impacting the target with a projectile causes the target to move and disassociate from the actuation mechanism and to be returned to the retracted position by the biasing mechanism; and a second biasing mechanism for biasing the target into contact with the actuation mechanism.

19. A target system, comprising:

a target configured to be movable between a retracted position and an extended position, wherein the target is presented to a shooter in the extended position;

a catch configured to releasably engage the target and move the target from the retracted position into the extended position, the catch moving in substantially the same path between extended and retracted positions as the target after the target has been impacted by a bullet, wherein the catch is moved pneumatically between extended and retracted positions;

a first biasing member operationally connected to the target and configured to move the target back into the retracted position; and a second biasing member for biasing the target into engagement with the catch.

20. The target system of claim 19, wherein the first biasing member has a force greater than the weight of the target to thereby hold the target in the retracted position even if the retracted position is above the extended position.

21. The target system of claim 19, further comprising a generally stationary base, a carriage slidable relative to the base, the carriage being attached to the target for carrying the target and an actuation mechanism including the catch, the actuation mechanism moving the catch alongside the base to move the target from the retracted position to the extended position.

* * * * *